US006097358A

United States Patent [19]

Hirakawa et al.

[11] Patent Number: 6,097,358

[45] Date of Patent: Aug. 1, 2000

[54] AC PLASMA DISPLAY WITH PRECISE RELATIONSHIPS IN REGARDS TO ORDER AND VALUE OF THE WEIGHTED LUMINANCE OF SUB-FIELDS WITH IN THE SUB-GROUPS AND ERASE ADDRESSING IN ALL ADDRESS PERIODS

[75] Inventors: Hitoshi Hirakawa; Yasushi Yoneda, both of Kawasaki, Japan

[73] Assignee: Fujitsu Limited, Kawasaki, Japan

[21] Appl. No.: 09/045,043

[22] Filed: Mar. 20, 1998

[30] Foreign Application Priority Data

Sep. 18, 1997 [JP] Japan ..... 9-253759

[51] Int. Cl.[7] ..... G09G 3/28; G09G 5/10

[52] U.S. Cl. ..... 345/63; 345/148

[58] Field of Search ..... 315/169.1, 169.2, 315/169.3, 169.4; 345/55, 63, 77, 60, 72, 147, 148, 204, 208

[56] References Cited

U.S. PATENT DOCUMENTS

| | | | |
|---|---|---|---|
| 5,420,602 | 5/1995 | Kanazawa | 345/67 |
| 5,436,634 | 7/1995 | Kanazawa | 345/60 |
| 5,446,344 | 8/1995 | Kanazawa | 315/169.4 |
| 5,541,618 | 7/1996 | Shinoda | 345/63 |
| 5,724,054 | 3/1998 | Shinoda | 345/63 |
| 5,745,086 | 4/1998 | Weber | 345/63 |
| 5,818,419 | 10/1998 | Tajima et al. | 345/147 |
| 5,898,414 | 4/1999 | Awamoto et al. | 345/148 |
| 5,940,142 | 8/1999 | Wakitani et al. | 345/147 |
| 5,943,032 | 8/1999 | Nagaoka et al. | 345/63 |
| 5,952,986 | 9/1999 | Nguyen et al. | 345/60 |
| 5,959,619 | 9/1999 | Kameyama et al. | 345/204 |
| 5,963,184 | 10/1999 | Tokunaga et al. | 345/60 |

FOREIGN PATENT DOCUMENTS

| | | |
|---|---|---|
| 0157248 | 10/1985 | European Pat. Off. . |
| 0549275 | 6/1993 | European Pat. Off. . |
| 4-195188 | 7/1992 | Japan . |
| 2639311 | 4/1997 | Japan . |

OTHER PUBLICATIONS

Patent Abstracts of Japan, vol. 95, No. 5, Jun. 30, 1995 for JP 07049663 (NEC Corp.), Feb. 21, 1995.

*Primary Examiner*—Steven J. Saras
*Assistant Examiner*—Paul A. Bell
*Attorney, Agent, or Firm*—Staas & Halsey, LLP

[57] ABSTRACT

A method for driving an AC-driven PDP to produce gradation display by dividing a field into at least three sub-fields in time sequence, each of the sub-fields having a weighted luminance and being provided with an address period for selecting a cell to emit light for display and a sustain period for sustaining a light-emitting state. The method includes the steps of grouping the sub-fields into at least two sub-field groups, carrying out a charge forming operation, as preparation for addressing, directly before each of the sub-field groups so as to form wall charge necessary for sustaining the light-emitting state in all cells on an entire screen, and carrying out an erase addressing, in the address period of each of the sub-fields, for erasing the wall charge in a cell which need not emit light.

16 Claims, 8 Drawing Sheets

AC PLASMA DISPLAY WITH PRECISE RELATIONSHIPS IN REGARDS TO ORDER AND VALUE OF THE WEIGHTED LUMINANCE OF SUB-FIELDS WITH IN THE SUB-GROUPS AND ERASE ADDRESSING IN ALL ADDRESS PERIODS

CROSS-REFERENCE TO RELATED APPLICATION

This application is related to Japanese application No. HEI 9(1997)-253759, filed on Sep. 18, 1997 whose priority is claimed under 35 USC § 119, the disclosure of which is incorporated by reference in its entirety.

BACKGROUND OF THE INVENTION

1. Field of the Invention

The present invention relates to a method for driving an AC-driven plasma display panel (PDP) and also relates to a plasma display device to which the method applies.

2. Description of Related Art

A PDP is a flat display device of a self-luminous type having a pair of substrates as a support. Since the PDP capable of color display was put to practical use, the PDP has wider applications, for example as a display of television pictures or a monitor of a computer. The PDP is now attracting attention also as a large, flat display device for high-definition TV.

The AC-driven PDP is a PDP constructed to have main electrodes covered with a dielectric to allow a so-called memory function of maintaining light-emission discharges for display by utilizing wall charge. For producing an image with the PDP, row by row addressing is carried out to form a charged state only in cells which are to emit light for display, and then a sustain voltage Vs for sustaining the light-emission discharges of alternating polarities is applied to all cells. The sustain voltage VS satisfies the following formula (1):

$$Vf-Vwall<Vs<Vf \qquad \text{Formula (1)}$$

wherein Vf is a firing voltage, i.e., a discharge at start voltage, and Vwall is a wall voltage.

In cells having the wall charge, the wall voltage is superposed on the sustain voltage Vs, and therefore an effective voltage Veff present in the cells, which is also called a cell voltage, exceeds the firing voltage Vf to generate an electric discharge. If the sustain voltage Vs is applied at sufficiently short cycles, apparently continuous light emission can be obtained. Luminance of display depends on the number of discharges generated per unit time. Accordingly, gradation display (display of gray scales) is reproduced by setting a proper number of discharges per field (per frame in the case of non-interlaced scanning) for every cell in accordance with desired gradation levels. Color display is a kind of gradation display, and colors are produced by combining three primary colors with changing luminance of the colors.

For performing gradation display with the PDP, it is generally known from Japanese Unexamined Patent Publication No. HEI 4(1992)-195188 that one field is divided into a plurality of sub-fields each having aweighted luminance, i.e., number of discharges, and the total number of discharges in one field is set by deciding light emission or non-light-emission in each of the sub-fields. In general, the luminance of the sub-fields is weighted by so-called "binary weighting" which lays weights represented by $2^n$ wherein n=0, 1, 2, 3, . . . . For example, if the number of sub-fields is eight, 256 levels of gradation, i.e., gradation level "0" to gradation level "255," can be displayed.

The binary weighting is suitable for multi-gradation. However, in order to uniform a difference in luminance corresponding to one level of gradation (hereafter referred to as a gradation difference) all over a total range of gradation, addressing must be carried every sub-field, and resetting (preparation for the addressing) must also be carried out for forming a uniformly charged state on an entire screen prior to the addressing of each sub-field. If the resetting is not performed, cells having residual wall charge, i.e., cells having been selected to have light-emission discharges for display in the preceding sub-field, are different in dischargeability from other cells, i.e., cells not having been selected for display in the preceding sub-field. Therefore it is difficult to carry out the addressing with reliability. Since the resetting and addressing involve an electric discharge, it is desirable that the number of resettings and addressings be reduced for good contrast and reduction of electric power consumption. Especially in the case of a high-definition PDP, it is earnestly desired also for the purpose of preventing the generation of heat that the number of addressings be reduced since a load on a circuit components for the addressing is large.

For this purpose, Japanese Patent No. 2639311 proposes a method for driving a PDP wherein a number of sub-fields are grouped into a plurality of groups, sub-fields belonging to the same group are equally weighted and the resetting is carried out once for every group of sub-fields.

FIG. 8 is a schematic view illustrating the conventional driving method.

In the example of FIG. 8, a field f is composed of nine sub-fields sf1 to sf9, which are grouped into three groups sfg1 to sfg3 each consisting of three sub-fields. Sub-fields sf1 to sf3 belonging to a first sub-field group sfg1 are each weighted by one, sub-fields sf4 to sf6 belonging to a second sub-field group sfg2 are each weighted by four, and sub-fields sf7 to sf9 belonging to a third sub-field group sfg3 are each weighted by sixteen. With this construction of the field, 64 levels of gradation, i.e., level "0" to level "63," can be displayed. Each of the sub-fields sf1 to sf9 is provided with an address period ta for the addressing and a sustain period ts, which is also referred to as a display period, for sustaining light-emission discharges. Each of the sub-field groups sfg1 to sfg3 is provided with a reset period tr for the resetting. The length of the address period is constant in all the sub-fields, i.e., a product of a scanning cycle per row and the number of the rows, while the sustain period ts is longer as a larger weight of luminance is put on the sustain period.

Conventionally, the resetting is performed by a charge erasing operation of eliminating residual wall charge and thereby rendering the entire screen into an uncharged state, and the addressing is performed by a selective writing operation of selecting only cells which are to emit light for display and forming new wall charge in the selected cells.

For example, in order to produce the gradation level "3," a cell may be selected to emit light during the sustain periods ts of the three sub-fields sf1 to sf3 whose luminances are each weighted by one. In this case, the entire screen is cleared of electric charge in the reset period tr of the first sub-field group sfg1, and the cell is written to form wall charge in the address period ta of the first sub-field sf1. This cell is not written in the address periods ta of the second and third sub-fields sf2 and sf3, but the light-emission discharges are sustained by use of remaining wall charge in the sustain periods TS of the sub-fields sf2 and sf3. Then, the wall charge is eliminated in the reset period tr of the second sub-field group sfg2 and thus the cell falls in a non-selected state wherein the cell does not generate a discharge on the application of a sustain voltage for sustaining the light-emission discharge. In order to reproduce the gradation level "2" in a cell, the cell is written in the address period ta of the second sub-field sf2 and the cell emits light in the sustain periods ts of the second and third sub-fields sf2 and sf3.

With this construction in which the timing of writing is varied in each of the sub-fields groups sfg1 to sfg3 according to a gradation level to be reproduced, the number of resettings can be reduced to the number of sub-field groups and the number of address writings in each cell can reduced equal to or less than the number of sub-field groups. Since the addressing here is of a write method, the addressing is not required when the gradation level to be reproduced is "0."

With the conventional driving method, however, a priming effect of space charge generated by the discharge for the resetting is large when the addressing immediately follows the resetting, while the priming effect becomes smaller as the interval between the resetting and the addressing becomes longer because the space charge decreases. Thus the incidence of discharge defects becomes high. That is, the production of a gradation level which requires light emission in only a few sub-fields of the sub-field groups sfg1 to sfg3 is not ensured. For this reason, it is difficult to increase the number of sub-fields belonging to each of the sub-field groups sfg1 to sfg3 thereby to increase the number of gradation levels to display without increasing power consumption for the addressing. In addition to that, the cycle for scanning a row must be set to a relatively large value of about 3.7 $\mu$s so that a necessary amount of wall charge is formed by the addressing. Therefore, in the case where the number of rows is 480, for example, one addressing requires about 1.78 ms and the maximum number of addressings that can be done in one field time (about 16.7 ms) is nine.

SUMMARY OF THE INVENTION

Under the above-described circumstances, an object of the present invention is to realize a stable operation for producing gradation display regardless of gradation levels to be reproduced in the case of performing a smaller number of addressings than the number of sub-fields grouped into some groups. Another object of the present invention is to increase the number of sub-fields belonging to one sub-field group and thereby increase the number of gradation levels to display without raising power consumption.

The present invention provides a method for driving an AC-driven PDP to produce gradation display by dividing a field into at least three sub-fields in time sequence, each of the sub-fields having a weighted luminance and being provided with an address period for selecting a cell to emit light for display and a sustain period for sustaining a light-emitting state, the method comprising the steps of grouping the sub-fields into at least two sub-field groups; carrying out a charge forming operation, as preparation for addressing, directly before each of the sub-field groups so as to form wall charge necessary for sustaining the light-emitting state in all cells on an entire screen; and carrying out an erase addressing, in the address period of each of the sub-fields, for erasing the wall charge in a cell which need not emit light.

In the present invention, an entire screen is uniformly charged for being prepared for addressing, and charge only in cell which need not emit light is erased in the addressing. Thus, even if a cell must be cleared of charge in the second sub-field or later and it takes a long time from the preparation for addressing to the discharge for erasure, space charge sufficient for the priming effect exists at the time of the discharge for erasure because the sustaining is carried out during the time from the preparation for addressing to the discharge for erasure.

According to the present invention, the entire screen is uniformly charged by a first step of reversing the polarity of wall charge and a second step of newly charging a cell whose wall charge has been erased. Thus, a uniformly charged state can be produced whether or not the cell has been selected in the immediately preceding sub-field, and the reliability of the addressing can be improved.

BRIEF DESCRIPTION OF THE DRAWINGS

The present invention is hereinafter described in details by way of embodiments with reference to the accompanying drawings, which are not intended to limit the scope of the invention, in which.

DESCRIPTION OF THE PREFERRED EMBODIMENTS

Figure 1:
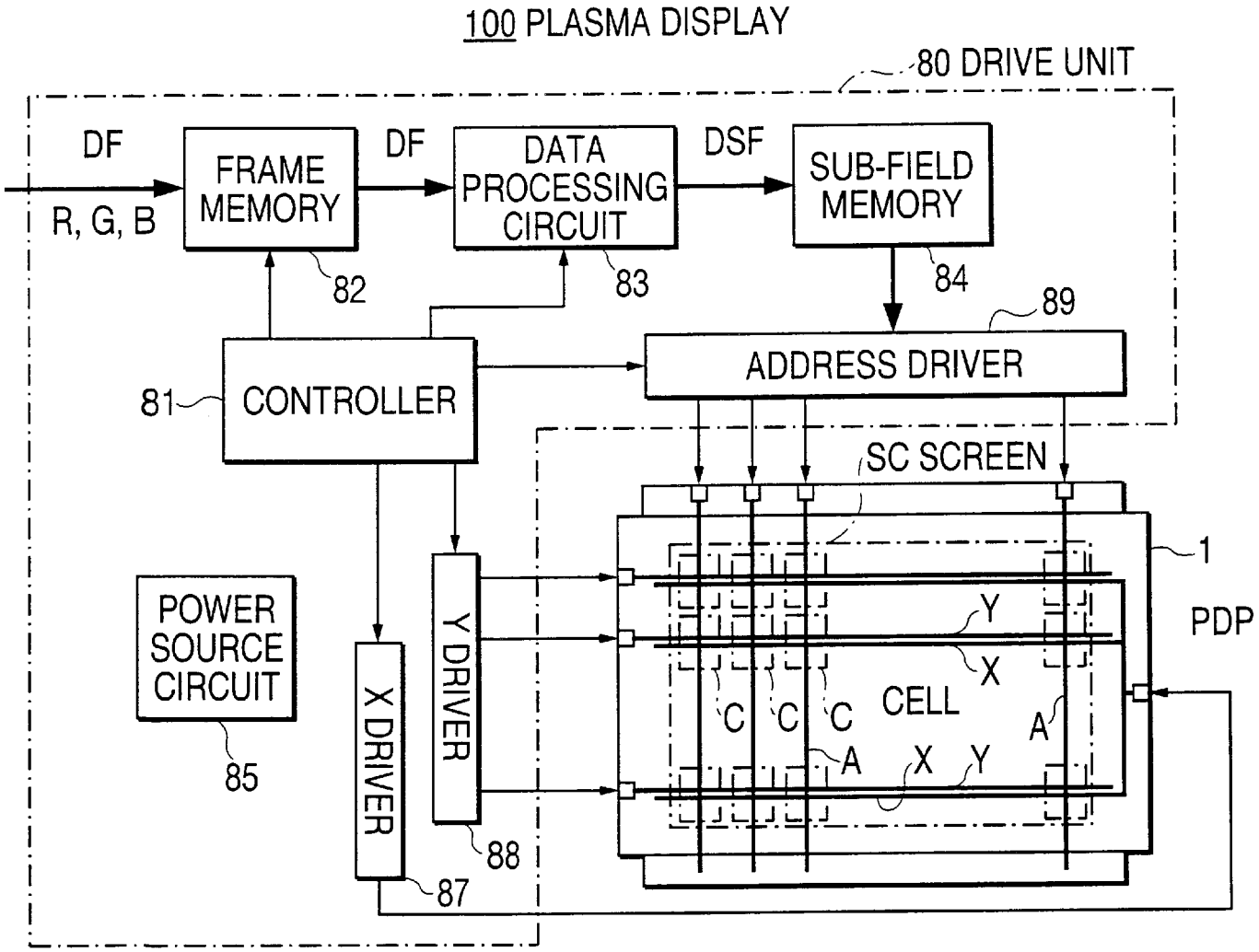
FIG. 1 is a diagram illustrating the structure of a plasma display in accordance with the present invention.

The field in the present invention is a unit image for time-sequential image display. That is, the field means each field of a frame in an interlaced scanning system in the case of television and a frame itself in a non-interlaced scanning system (which can be regarded as a one-to-one interlaced scanning) typified by an output of a computer.

In the present invention, the charge forming operation may include a first step of reversing the polarity of wall charge in ON-state cells in which the light-emitting state is sustained in the last sustain period before the present sub-field group and a second step of forming, in OFF-state cells which are other than the ON-state cells, wall charge of the same polarity as that in the ON-state cells.

Further, in the present invention, all sub-fields belonging to the same sub-field group may have the same weighted luminance, sub-fields belonging to different sub-field groups may have different weighted luminances, and provided that a sub-field belonging to a sub-field group having the smallest weighted luminances has a weighted luminance represented by an integer of one, the weighted luminance of a sub-field belonging to any other sub-field group may be a. an integer multiple of one, b. not larger than one plus the sum of all weighted luminances that are smaller than said weighted luminance, and c. larger than any weighted luminance that is smaller than said weighted luminance.

Alternately, at least one sub-field group may include at least two sub-fields having different weighted luminances.

Further, each of the sub-field groups may have a standard weighted luminance for sub-fields belonging to said each sub-field group, and provided that a sub-field group having the smallest standard weighted luminance has a weighted luminance represented by an integer of one, the standard weighted luminance of any other sub-field group may be a. an integer multiple of one, b. not larger than one plus the sum of all weighted luminances of sub-fields belonging to any other sub-field group whose standard weighted luminance is smaller than said standard weighted luminance, c. larger than any standard weighted luminance that is smaller than said standard weighted luminance. In this case, at least one sub-field of a sub-field group may have a weighted luminance smaller by one than the standard weighted luminance in said sub-field group.

In the second or later address period of a specific one of the sub-field groups, a voltage for erasing the wall charge may be applied again to a cell to which the voltage for erasing the wall charge has been applied in any of the preceding address periods in the specific sub-field group.

In this case, the specific sub-field group may be at least one sub-field group selected in descending order of the weighted luminance. Alternatively, the specific sub-field group may be at least one sub-field group selected in descending order of the sum of the weighted luminances.

According to the present invention, in a specific sub-field group, if all the cells receive the voltage for erasing wall charge by one or more erase addressing(s), substantial application of a voltage to the cells is stopped in a sustain period and an address period thereafter.

In this case, the specific sub-field group may be at least one sub-field group selected in descending order of the sum of the weighted luminances of the sub-fields belonging to each of the sub-field groups. Alternatively, the specific sub-field group may be at least one sub-fields group selected in descending order of the number of sub-fields.

In at least one sub-field selected in ascending order of the weighted luminance, a row scanning cycle for the erase addressing may be shorter than that in the other sub-fields.

Alternatively, in at least one of the sub-field groups selected in ascending order of the sum of the weighted luminances belonging to each of the sub-field groups, a row scanning cycle for the erase addressing may be shorter than that in the other sub-field groups.

The present invention also provides a method for driving an AC-driven PDP having a screen provided with a plurality of pixels arranged in matrix, the pixels having a memory function by use of wall charge, the method comprising the steps of dividing a field to be displayed on the screen into a plurality of sub-fields in time sequence, each of the sub-fields being further divided into an address period for selecting a pixel to emit light for display and a display period for sustaining a light-emitting state; carrying out a charge forming operation for forming wall charge necessary for sustaining the light-emitting state in all the pixels on the entire screen immediately before a set of sequential sub-fields; carrying out an erase addressing for selectively erasing the wall charge in a pixel which need not emit light, in the address period of a sub-field selected from said set of sequential sub-fields; and controlling the number of sub-fields between the charge forming operation carried out immediately before said set of sequential sub-fields and the erase addressing in the selected sub-field in accordance with luminance of each of the pixels to be displayed.

In this method, the charge forming operation may include a first process of reversing the polarity of the wall charge in ON-state pixels in which the light-emitting state is sustained in the last sustain period before the present sub-field and a second process of forming, in precedingly OFF-state pixels which are other than the ON-state pixels, wall charge of the same polarity as that of the ON-state pixels.

The present invention further provides a plasma display device comprising a three-electrode surface discharge PDP having a first main electrode and a second main electrode both extending in a direction of a row, an address electrode extending in a direction of a column, and a dielectric layer for covering the first main electrode and the second main electrode against a discharge gas space and a drive circuit for applying to the PDP a voltage in a sequence to which one the above-described methods for driving an AC-driven PDP is adapted.

EXAMPLES

FIG. 1 is a diagram illustrating the structure of a plasma display 100 according to the present invention.

The plasma display 100 includes an AC-driven PDPL which is a color display divide utilizing a matrix display system and a drive unit 80 for selectively lighting a large number of cells C composing a screen SC. The plasma display 100 can be used as a wall-mounted television display device and a monitor of a computer system.

The PDP 1 is a three-electrode surface discharge PDP in which pairs of sustain electrodes X and Y are disposed in parallel as the first and second main electrodes and define cells as display elements at their intersections with address electrodes A as the third electrodes. The sustain electrodes X and Y extend in the direction of rows, i.e., in the horizontal direction, on the screen. The electrodes Y are used as scanning electrodes to select cells row by row in addressing. The address electrodes A extend in the direction of columns, i.e., in the vertical direction, and are used as data electrodes to select cells column by column in the addressing. An area where the sustain electrodes intersect the address electrodes is a display area, that is, a screen.

The drive unit 80 includes a controller 81, a frame memory 82, a data processing circuit 83, a sub-field memory 84, a power source circuit 85, an X driver circuit 87, a Y driver circuit 88 and an address driver circuit 89. Field data DF representative of luminance levels of the individual cells, i.e., gradation levels, for individual colors R, G and B are inputted to the drive unit 80 from external equipment such as a TV tuner or computer.

The field data DF are stored in the frame memory 82 and then transferred to the data processing circuit 83. The data processing circuit 83 is data converting means for setting combination of sub-fields in which the cells emit light and outputs sub-field data DSF in accordance with the field data DF. The sub-field data DSF are stored in the sub-field memory 84. Each bit of the sub-field data has a value representing whether or not a cell must emit light in a sub-field, more strictly whether or not an address discharge takes place in a sub-field.

The X driver circuit 87 applies a drive voltage to the sustain electrodes X and the Y driver circuit 88 applies a drive voltage to the sustain electrodes Y. The address driver circuit 89 applies a drive voltage to the address electrodes according to the sub-field data DSF. These driver circuits are supplied with power from the power source circuit 85.

Figure 2:
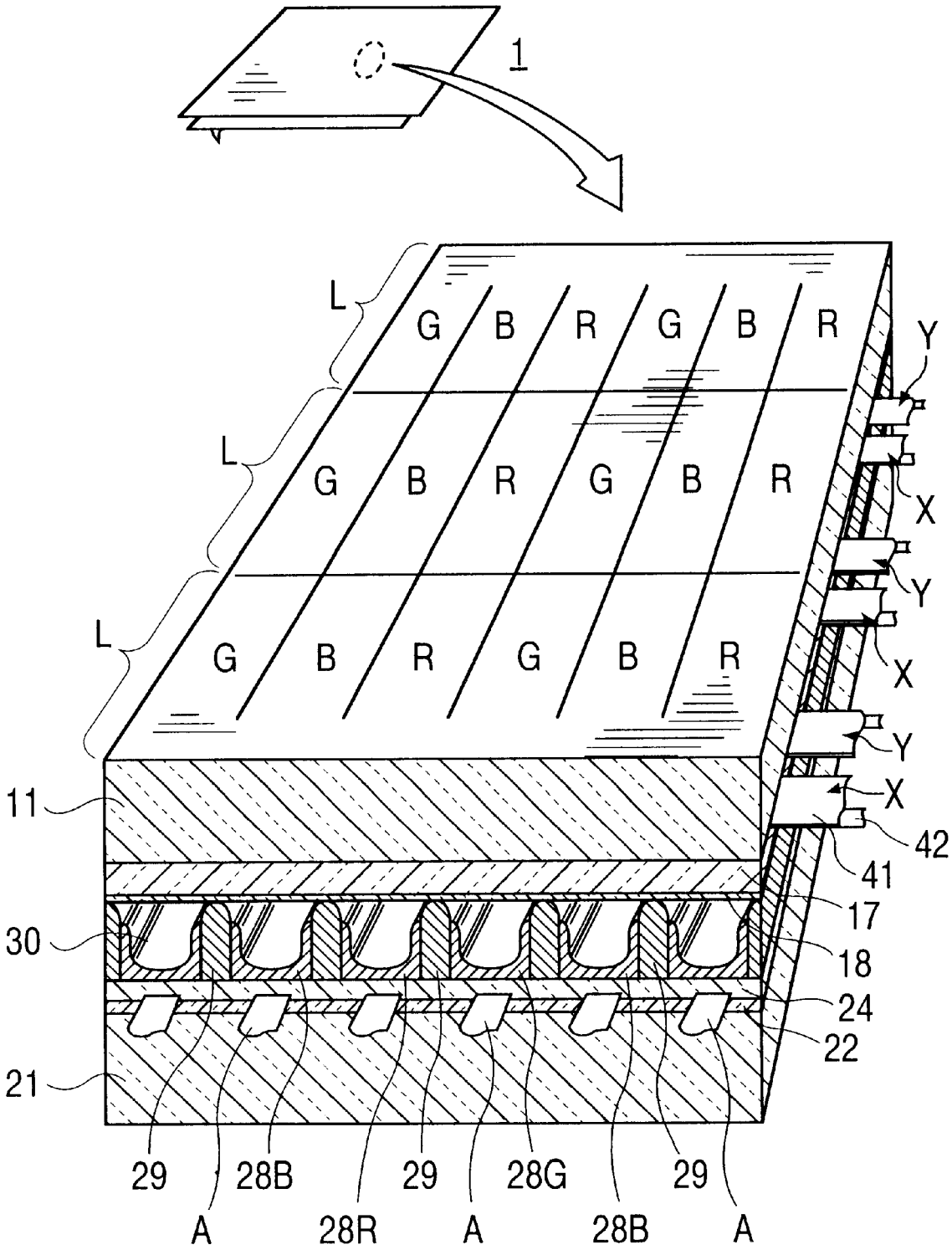
FIG. 2 is a perspective view illustrating an inner construction of a plasma display panel in accordance with the present invention.

FIG. 2 is a perspective view illustrating the inner construction of the PDP 1.

In the PDP 1, a pair of sustain electrode X and Y is disposed on each row of cells in the horizontal direction on the matrix screen on an inside surface of a glass substrate 11. Each of the sustain electrodes X and Y includes a electrically conductive transparent film 41 and a metal film (bus conductor) 42 and is covered with a dielectric layer 17 of a low-melting glass of 30 μm in thickness. A protection film 18 of magnesia (MgO) of several thousand angstrom in thickness is formed on a surface of the dielectric layer 17. The address electrodes A are placed on a base layer 22 which covers an inside surface of a glass substrate 21. The address electrodes A are covered with a dielectric layer 24 of about 10 μm in thickness. On the dielectric layer 24, ribs 29 of about 150 μm in height in the form of a linear band in a plan view are each disposed between the address electrodes A. These ribs 29 partition a discharge space 30 into sub-pixels, i.e., light-emission units, in the direction of the rows and also define a spacing for the discharge space between the substrates. Fluorescent layers 28R, 28G and 28B of three colors R, G and B for color display are formed to cover surfaces above the address electrodes and side walls of the ribs 29. The ribs are preferably colored dark on the top portions and white in the other portions to reflect visible light well for improving contrast. The ribs can be colored by adding pigments of intended colors to a glass paste which is a material for the ribs.

The discharge space 30 is filled with a discharge gas of neon as the main component with which xenon is mixed (the pressure in the panel is 500 Torr). The fluorescent layers 28R, 28G and 28B are locally excited by ultraviolet rays irradiated by xenon to emit light when an electric discharge takes place. One pixel for display is composed of three adjacent sub-pixels placed in the direction of the row. The sub-pixels in the respective columns emit light of the same color. The structural unit in each of the sub-pixels is a cell C (display element). Since the ribs 29 are arranged in a stripe pattern, portions of the discharge space 30 which correspond to the individual columns are vertically continuous, bridging all the rows. For this reason, the gap between the electrodes in adjacent rows (referred to as a reverse slit) is set to be sufficiently larger than a gap to allow a surface discharge in each of the rows, e.g., 80 to 140 μm, in order to prevent coupling by an electric discharge between cells in a column. For example, the gap may preferably be about 400 to 500 μm. Additionally, for the purpose of covering fluorescent layers in the reverse slits, which do not emit light and looks whitish, light-tight films are provided on the outer or inner surface of the glass substrate 11 corresponding to the reverse slits.

It is now explained how the PDP 1 of the plasma display 1 can be driven.

Figure 3:
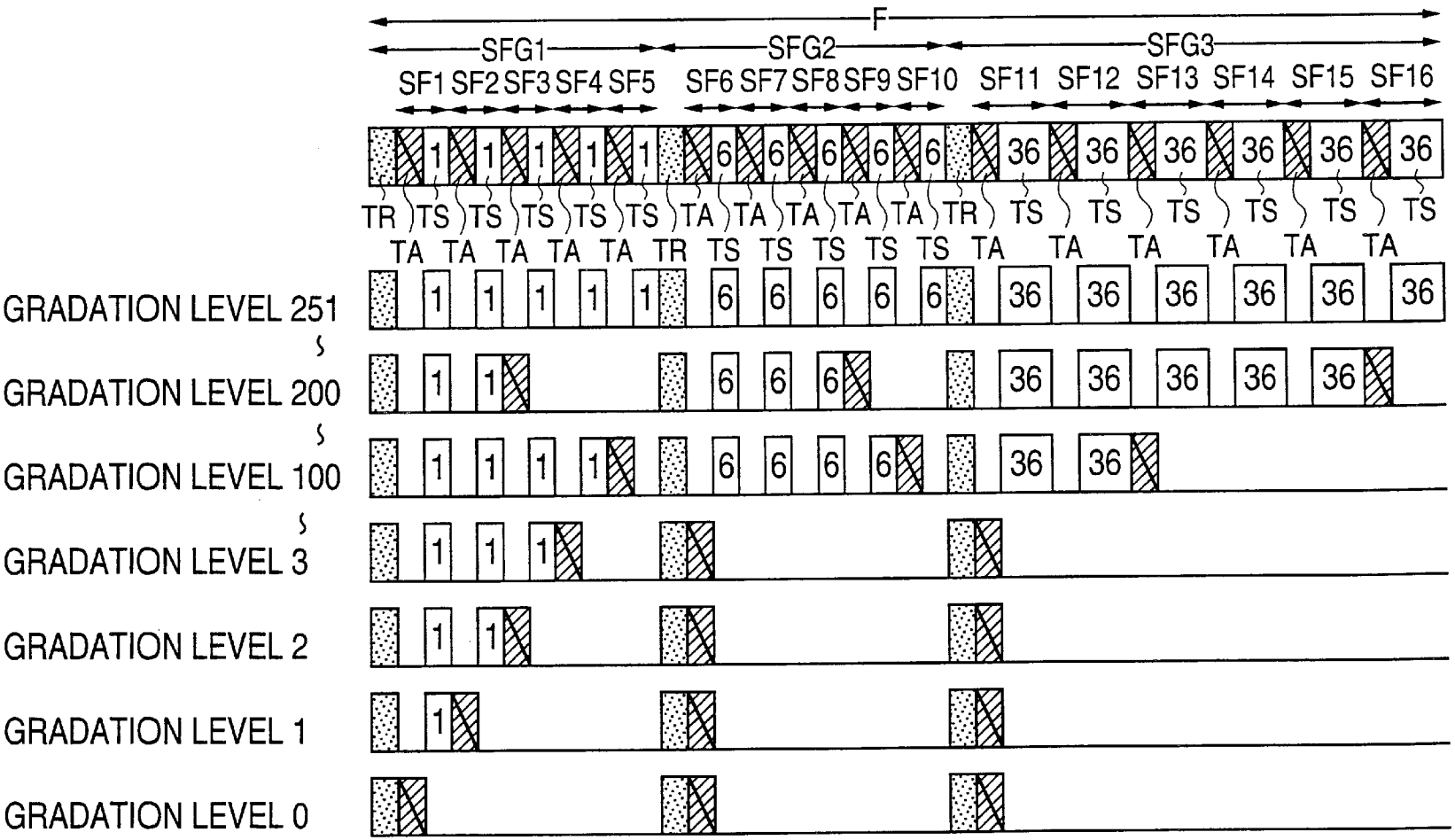
FIG. 3 is a schematic view illustrating a driving method in accordance with the present invention.

FIG. 3 is a schematic view illustrating a driving method of the present invention.

For reproducing gradation display by the binary control of light-emission, fields F which are images inputted in time sequence are each divided into 16 sub-fields SF1, SF2, SF3, SF4, SF5, SF6, SF7, SF8, SF9, SF10, SF11, SF12, SF13, SF14, SF15 and SF16. In other words, the image of the field F is displayed as a set of images of the 16 sub-fields SF1 to SF16. An address period TA and a sustain period (display period) TS are provided for each of the sub-fields SF1 to SF16. In order to reduce the number of addressings, the sub-fields SF1 to SF16 are grouped into plural groups, for example, three sub-field groups SFG1, SFG2 and SFG3. A group of five sub-fields from the first to the fifth in order of display, SF1 to SF5, is a first sub-field group SFG1, a group of five sub-fields from the sixth to the tenth SF6 to SF10 is a second sub-field group SFG2, and a group of six sub-fields from the eleventh to the sixteenth SF11 to SF16 is a third sub-field group SFG3. An address preparation period TR for preparing for the addressing is provided for each of the sub-field groups SFG1 to SFG3. In this example, the weight of luminance of all the sub-fields belonging to the first sub-field group SFG1 is set to the minimum "1," the weight of luminance of all the sub-fields belonging to the second sub-field group SFG2 is set to "6" and the weight of luminance of all the sub-fields belonging to the third sub-field group SFG3 is set to "36." Here, in the second and third sub-field groups SFG2 and SFG3, the respective weights of luminance are integer multiples of the minimum weight "1" and equal to one plus the total sum of the weights smaller than themselves. That is, $6=1\times5+1$ and $36=1\times5+6\times5+1$. With this construction of the field with luminance weights, 252 levels of gradation "0" to "251" can be produced with uniform difference in luminance between levels by changing combination of lighting and non-lighting in the sub-fields. Thus the plasma display 100 can be reproduce $252^3$ colors.

In each of the sub-field groups SFG1 to SFG3, not all the sub-fields belonging thereto are required to be weighted equally, but the luminance weights of the sub-fields may suitably be selected. For example, the luminance of the sub-field SF11 in the sub-field group SFG3 is weighted by "35". For obtaining the luminance of weight "36," a cell may emit light in the sub-field SF11 of luminance weight "35" and the sub-field SF1 of luminance weight "1." The sub-fields need not be displayed in order of luminance weights. For example, a sub-field having a large luminance weight may be placed in the middle of the field period for optimization. It is desirable to avoid an extreme continuation of the light-emitting or non-light-emitting state with a view to preventing pseudo-contour with moving pictures. The pseudo-contour with moving pictures, which is also called motion picture disturbance, is a phenomenon that a false contour is perceived by human retina. This phenomenon sometimes occurs when light emission is turned off or on in a sub-field with a large weight of luminance. The sub-fields belonging to each of the sub-field groups SFG1 to SFG3 are displayed continuously and are not interrupted by a sub-field belonging to any other sub-field group.

The address preparation period TR is provided at the beginning of each of the sub-field groups SFG1 to SFG3. In this address preparation period TR, the charge forming operation is carried out to form, in all cells, wall charge which are necessary for sustaining the light-emission by a drive sequence described later. Accordingly, if a sustain voltage for sustaining a light-emission discharge is applied directly after the charge forming operation has been done, every cell emits light. In the address period TA of each of the sub-fields, the erase addressing is carried out to erase the wall charge only in cells which are not required to emit light. The cells whose wall charge has been erased do not emit light on the application of the sustain voltage until the charge forming operation is performed again. In the sustain period TS, the sustain voltage of the alternating polarity is applied to all the cells and the light-emitting state is maintained in cells retaining the wall charge. In each of the sub-field groups SFG1 to SFG3, a cell which displays a gradation level requiring light emission in m ($0\leqq m<n$) sub-fields out of the n (n=5 or 6) sub-fields belonging to the sub-field group is cleared of the wall charge in the (m+1)-th address period TA. A cell which displays a gradation level requiring light emission in n sub-fields is not cleared of the wall charge.

For example, for reproducing the gradation level "3" in a cell, the cell may be lighted in the sustain periods TS of the three sub-fields SF1 to SF3 each having the luminance weight of "1." In this case, the wall charge is formed on the whole screen in the address preparation period TR of the first sub-field group SFG1, and the wall charge of the cell is erased in the address period TA of the fourth sub-field SF4. In the case where the gradation level "2" is reproduced in a cell, the wall charge of the cell is erased in the address period TA of the third sub-field SF3, and the cell does not emit light in the sustain periods TS of the third to fifth sub-fields SF3 to SF5.

Thus, by changing the timing of erasing the wall charge in each of the sub-field groups SFG1 to SFG3 according to the gradation levels to be reproduced, the number of charge formations all over the screen can be reduced to the number of sub-field groups and the number of address discharges in one cell can be reduced to or under the number of sub-field groups. Since the addressing of this method is of an erase method, the addressing is not needed when the gradation level to be reproduced is the maximum "251."

Figure 4:
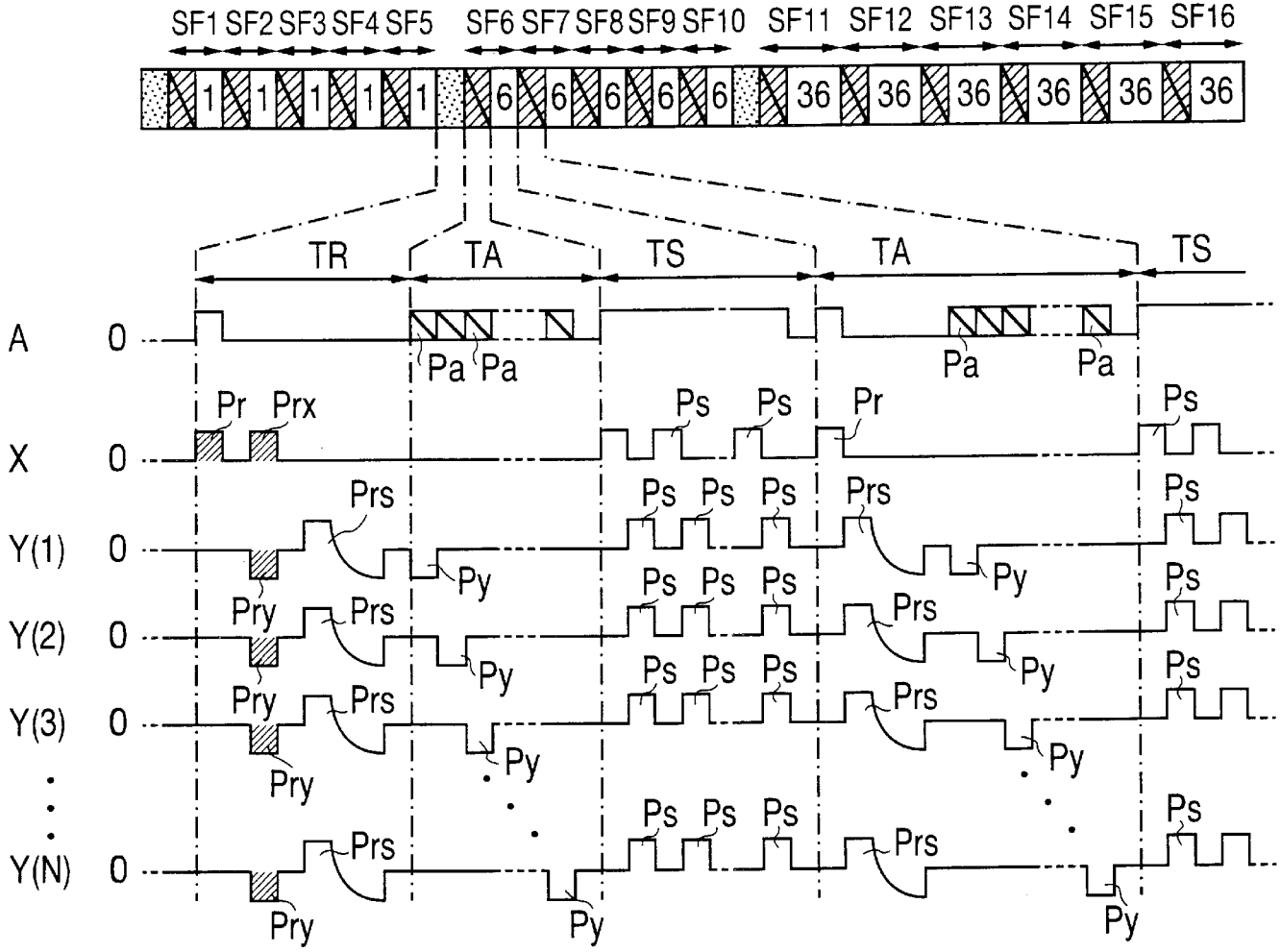
FIG. 4 shows waveforms explaining a drive sequence.

FIG. 4 shows waveforms explaining a drive sequence according to the present invention.

In the address preparation period TR of each of the sub-field groups SFG1 to SFG3, the wall charge of a predetermined polarity is formed in both ON cells (ON-state cells which has been selected to emit light for display in the immediately preceding sustain period and therefore in which a light-emitting state has been sustained) and OFF cells (OFF-state cells which has not been selected to emit light for display in the immediately preceding sustain period and therefore in which the light-emitting state has not been sustained) by a first step of applying a voltage pulse Pr of positive polarity to the sustain electrodes X and a second step of applying a voltage pulse Prx of positive polarity to the sustain electrodes X and a voltage pulse Pry of negative polarity to the sustain electrodes Y, as explained below. In the first step, the address electrodes A are biased to a positive potential to prevent an unnecessary discharge across the address electrodes A and the sustain electrodes X. Subsequently to the second step, a voltage pulse Prs of positive polarity is applied to the sustain electrodes Y to generate surface discharge in all the cells so that the cells are more uniformly charged. By this surface discharge, the polarity of the wall charge is reversed. Then, the potential of the sustain electrodes Y is gradually reduced to avoid loss of the charge.

In the address period TA following the address preparation period TR, the rows are selected row by row from the first row, and a scan pulse Py of negative polarity is applied to the sustain electrode Y of the selected row. At the same time as the row is selected, an address pulse Pa of positive polarity is applied to the address electrode A which corresponds to a cell not to emit light this time. In a cell on the selected row to which the address pulse Pa is applied, an opposition discharge occurs across the sustain electrode Y and the address electrode A. Thereby the wall charge on the dielectric layer 17 in the cell disappears. When the address pulse Pa is applied, the wall charge of positive polarity exists near the sustain electrode X. This wall charge cancels the address pulse Pa and a discharge does not occur across the sustain electrode X and the address electrode A. Such erase addressing is suitable for high-speed display because the erase addressing does not require wall charge to be re-formed unlike write addressing. More particularly, time necessary for addressing one row, i.e., a row scanning cycle, is about 1.5 μs, which is equal to or less than half of the row scanning cycle required by the write addressing. In the case where the number of rows is 480, the time required for one addressing is 720 μs and the sum of 16 address periods TA is 11.5 ms, which is about 69% of the entire field period.

In the sustain period TS, all the address electrodes A are biased to a positive potential for preventing an unnecessary discharge, and the sustain pulse Ps of positive polarity is applied to all the sustain electrodes X first. Then the sustain pulse Ps is applied alternatively to the sustain electrodes Y and the sustain electrodes X. In this example, the last sustain pulse Ps is applied to the sustain electrodes Y. By the application of the sustain pulse Ps, a surface discharge is generated in cells whose wall charge has not been erased in the address period TA, i.e., cells to emit light in the current sub-field.

In the address period TA following the sustain period TS, the voltage pulse Pr and a voltage pulse Prs are applied to the sustain electrodes X and the sustain electrodes Y, respectively, for the purpose of adjusting charge distribution. Then, the potential of the sustain electrodes Y is gradually reduced as in the address preparation period TR, and then the addressing is carried out row by row as in the first address period TA.

Figure 5:
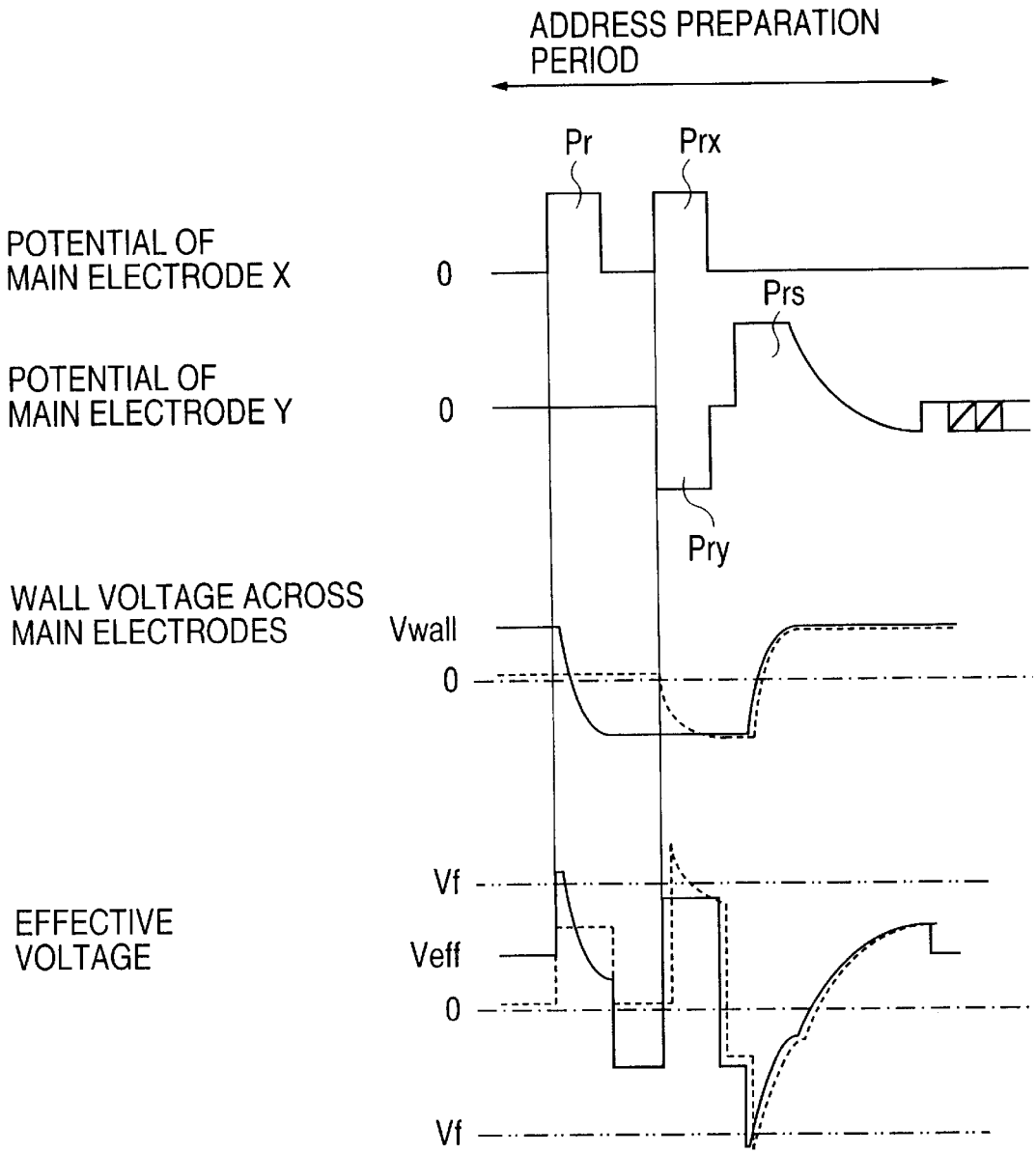
FIG. 5 shows waveforms explaining a basic conception of the preparation for addressing in accordance with present invention.

FIG. 5 shows waveforms explaining a basic conception of the preparation for addressing in accordance with the present invention. Referring to the figure, the polarity of the wall voltage Vwall and the effective voltage Veff is shown with respect to the potential of the sustain electrode Y.

At the beginning of the address preparation period TR, the wall charge generated by the surface discharge for sustaining the light-emission discharge remain in the ON cells. The polarity of the wall charge is positive on the side of the sustain electrode X and negative on the side of the sustain electrode Y because the last sustain pulse Ps is applied to the sustain electrode Y as described above. Accordingly, a positive wall voltage Vwall is present across the sustain electrodes (main electrodes) in the ON cells. On the other hand, in the OFF cells, the wall voltage is zero because the wall charge is erased by the preceding addressing.

If the sustain electrode X receives a voltage pulse Pr whose crest value is the same as or close to that of the sustain pulse Ps, the effective voltage Veff in the ON cells exceeds a firing voltage Vf as indicated by a solid line in the figure. Thereby the surface discharge is generated in the ON cells, so that the wall charge disappears and then is formed again. Thus the polarity of the wall charge is reversed. In the OFF cells, on the other hand, the effective voltage Veff does not exceed the firing voltage Vf, as indicated by a dotted line in the figure. Therefore the discharge does not occur and the uncharged state is maintained.

Subsequently, if voltage pulses of Prx and Pry of different polarities whose crest values are set such that applied voltage is about twice as high as the sustain voltage (the crest value Vs of the sustain pulse Ps) the effective voltage Veff in the OFF cells exceeds the firing voltage Vf to generate the surface discharge. Thereby the same negative wall voltage Vwall as that present in the ON cells is present in the OFF cells. In the ON cells, on the other hand, the existing wall voltage Vwall lowers the applied voltage, so that the effective voltage Veff does not exceed the firing voltage Vf. Accordingly, the charged state is maintained in the ON cells. Thus, the ON cells and the OFF cells are charged similarly. However, there are cases where the amount of charge in the ON cells differs to some extent from the amount of charge in the OFF cells (usually the OFF cells has a larger amount of charge). In consideration of that, the voltage pulse Prs is applied to generate a surface discharge to uniform the amount of charge.

Since the entire screen is thus charged by two steps by use of the remaining wall charge, more uniform charge distribution can be obtained compared with the case where a charged state is formed only by one discharge. Thus the reliability of the addressing is improved.

Figure 6:
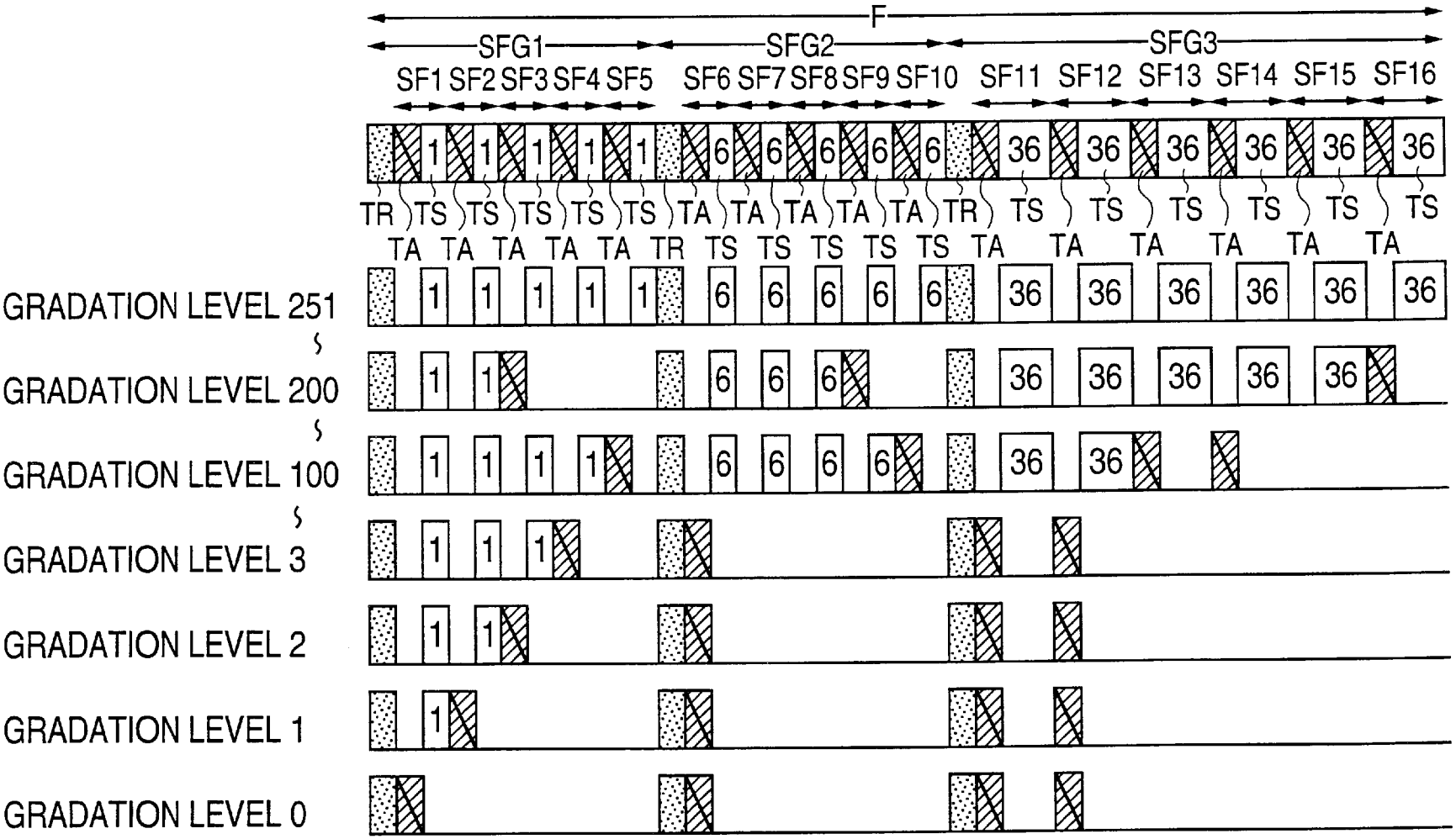
FIG. 6 is a schematic view illustrating an alternative driving method in accordance with the present invention.

FIG. 6 is a schematic view illustrating a modified driving method in accordance with the present invention.

In a specific sub-field group (SFG3 in the example shown in the figure), a cell whose wall charge is erased in one address period is subjected to the erase addressing in at least one address period(s) TA after that address period by use of the same sub-field data DSF. Thus, even if there is a failure in the address discharge and a cell which should not emit light happens to emit light, the unnecessary wall charge in the cell is erased by repeating the erase addressing and the cell falls in the non-light-emitting state. In usual cases, the first erase addressing rarely fails to erase the unnecessary wall charge. Accordingly, a discharge hardly takes place in the second and later erase addressing and the contrast of display does not decline.

The above-described repeated addressing can be performed in all the sub-field groups SFG1 to SFG3. However, taking it into consideration that a failure in the address discharge rarely happens and, if it happens, it affects little a sub-field having a small luminance weight (luminance rises only slightly by erroneous emission of light), it is desirable that the specific sub-field group be selected in descending order of luminance weight or the sum of luminance weights in the sub-field groups. For, in the case where the address discharge successfully takes place in the first addressing and the discharge does not take place in the second and later addressing, the application of the scan pulse Py and the address pulse Pa consumes power for charging the cell. It may also be effective for reducing power consumption to limit the number of repeated addressings to one, two or three.

In the example shown in FIG. 6, the specific sub-field group is the sub-field group SFG3 which includes sub-fields of the largest luminance weight or which has the largest sum of luminance weights, and the addressing is repeated only once therein. Thus the total number of addressings is two.

Figure 7:
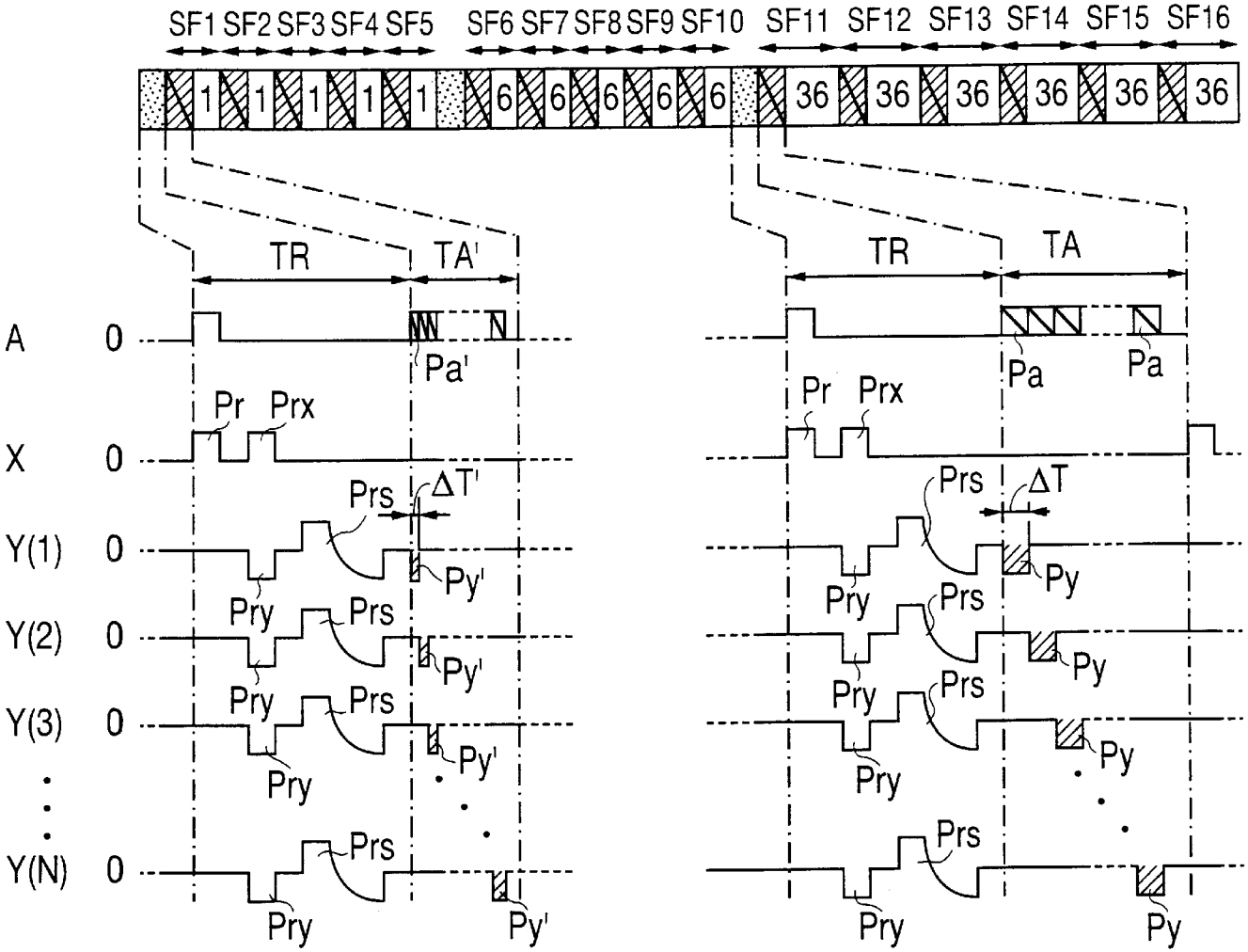
FIG. 7 shows waveforms explaining an alternative drive sequence.
Figure 8:
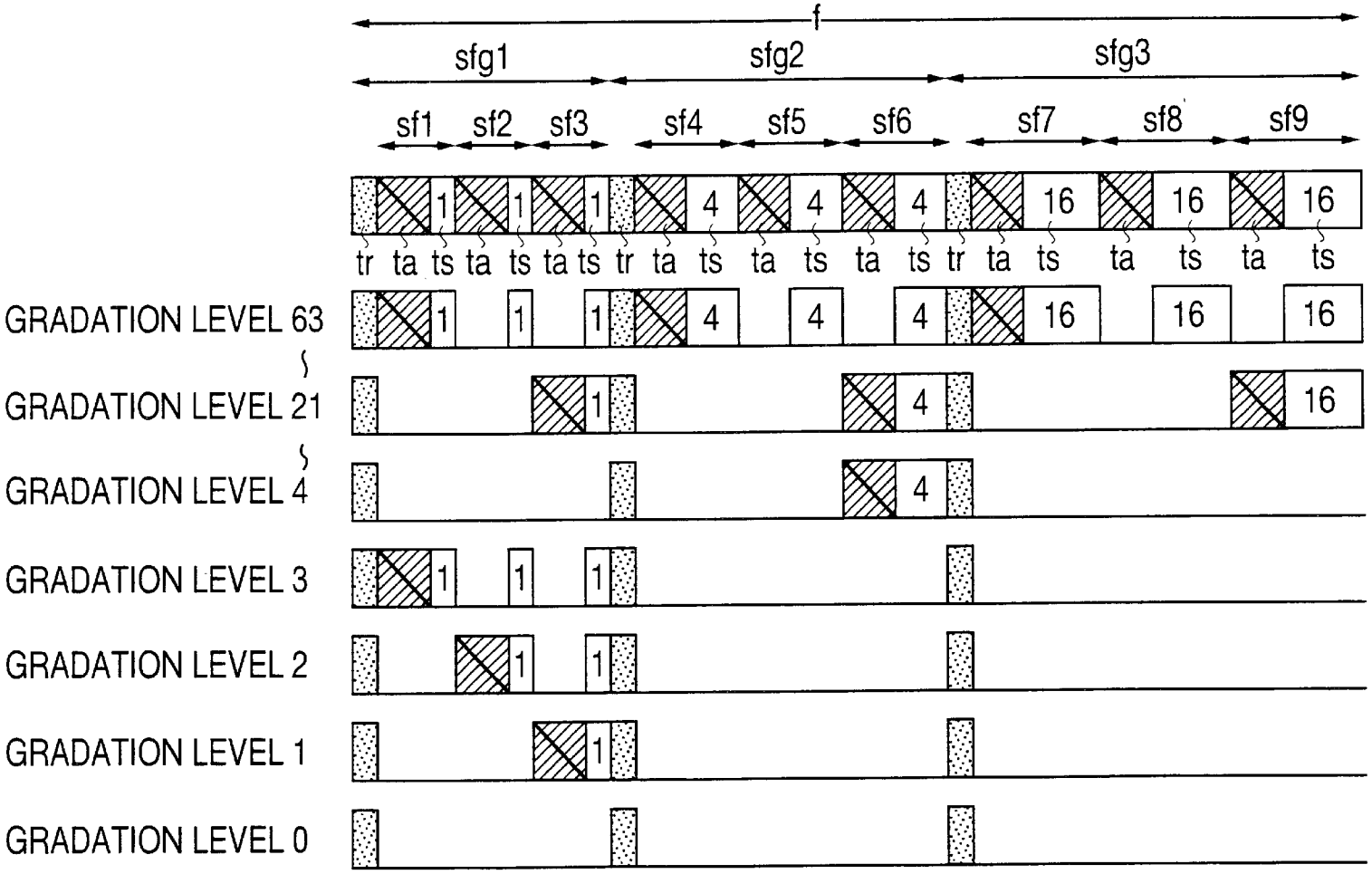
FIG. 8 (PRIOR ART)
FIG. 8 is a schematic view illustrating a conventional driving method.

FIG. 7 shows waveforms explaining a modified drive sequence.

An addressing failure less influences a sub-field whose luminance weight is small than a sub-field whose luminance weight is large. Accordingly, the row scanning cycle ΔT' for the sub-fields SF1 to SF5 having the smallest luminance weight is set shorter than the row scanning cycle ΔT for the other sub-fields SF6 to SF16. As a result, the address periods TA' of the sub-fields SF1 to SF5 become shorter than the address periods TA of the other sub-fields SF6 to SF16. This difference can be utilized for lengthening the sustain periods to raise the maximum luminance or for increasing the number of sub-fields to increase the number of gradation levels.

In some cases, none of the cells need to emit light after a certain sub-field of the sub-field group SFG1, SFG2 or SFG3 according to the content of display. If a voltage is applied to the cells during such time periods in which the light emission is not needed, power is consumed only for charging electrostatic capacity across the electrodes. Therefore, in a sub-field in which none of the cells need to emit light, not only the address pulse Pa but also the scan pulse Py and the sustain pulse Ps may not be outputted so that the application of voltages are substantially stopped. Such control is performed by the controller 81 on the basis of gradation data from the data processing circuit 83 (see FIG. 1). In order to simplify the control, this cessation of the application of voltages may be done only in a specific sub-field group. In such a case, it is preferable to select the specific sub-field group in descending order of luminance weight, in descending order of the sum of luminance weights or in descending order of the number of the sub-fields in terms of effective reduction of power consumption.

In the above-described examples, in order to reduce the deterioration of the fluorescent layers caused by the address discharge, the address pulse Pa is first set to be positive, and then the polarity of the other pulses is set in accordance with the positive address pulse Pa. The sustain pulse of positive polarity is applied alternately to one of the sustain electrodes for simplifying the drive circuit. The present invention, however, is not limited to these examples. That is, the polarity of voltages applied can be changed. As for the voltage pulses Prx and Pry in the second step of the charge forming operation, the setting of the crest values is optional, but it is advantageous for circuit construction to equipotentially oppose the voltage pulses Prx and Pry like a combination of Vs and −Vs as shown in the examples.

According to the present invention, in the case where sub-fields are grouped and gradation levels are reproduced by a smaller number of addressings than the number of sub-fields, operation can be stabilized regardless of gradation levels to be reproduced. Therefore, it has become possible to increase the number of sub-fields in sub-field groups thereby to increase the number of gradation levels without increasing electric power consumption.

Further, the cells can be charged more uniformly all over the screen than in the conventional method whether or not the cells have emitted light in the immediately preceding sub-field. Therefore the reliability of the addressing can be improved.

Further, light emission periods can be distributed more evenly during the whole field time, and thus the incidence of false outlines can be reduced.

Still further, if a discharge failure happens in the addressing, unnecessary light emission caused by the discharge failure can be minimized.

Further, the present invention can reduce consumption of electric power.

The present invention can also enable either of the improvement of luminance by lengthening the sustain period or the increase of the number of displayable gradation levels by increasing the number of sub-fields.

What is claimed is:

1. A method for driving an AC-driven PDP to produce gradation display by dividing a field into at least three sub-fields in time sequence, each of the sub-fields having a weighted luminance and being provided with an address period for selecting a cell to emit light for display and a sustain period for sustaining a light-emitting state, the method comprising the steps of:

grouping the sub-fields into at least two sub-field groups;

carrying out a charge forming operation, as preparation for addressing, directly before the first address period in each of the sub-field groups so as to form wall charge necessary for sustaining the light-emitting state in all cells on an entire screen; and carrying out an erase addressing, in the address period of each of the sub-fields, for erasing the wall charge in a cell which need not emit light.

2. The method according to claim 1, wherein the charge forming operation includes a first step of reversing the polarity of wall charge in an ON-state cell in which the light-emitting state is sustained in an immediately preceding sustain period and a second step of forming, in an OFF-state cell which is a cell other than the ON-state cell, wall charge of the same polarity as that in the ON-state cell.

3. The method according to claim 1, wherein:

all sub-fields belonging to the same sub-field group have the same weighted luminance;

sub-fields belonging to different sub-field groups have different weighted luminances; and provided that a sub-field belonging to a sub-field group having the smallest weighted luminances has a weighted luminance represented by an integer of one, the weighted luminance of a sub-field belonging to any other sub-field group is a. an integer multiple of one, b. not larger than one plus the sum of all weighted luminances that are smaller than said weighted luminance, and c. larger than any weighted luminance that is smaller than said weighted luminance.

4. The method according to claim 1, wherein at least one of the sub-field groups includes at least two sub-fields having different weighted luminances.

5. The method according to claim 1, wherein:

each of the sub-field groups has a standard weighted luminance for sub-fields belonging to said each sub-field group;

provided that a sub-field group having the smallest standard weighted luminance has a weighted luminance represented by an integer of one, the standard weighted luminance of any other sub-field group is a. an integer multiple of one, b. not larger than one plus the sum of all weighted luminances of sub-fields belonging to any other sub-field group whose standard weighted luminance is smaller than said standard weighted luminance, c. larger than any standard weighted luminance that is smaller than said standard weighted luminance; and at least one sub-field of a sub-field group has a weighted luminance smaller by one than the standard weighted luminance in said sub-field group.

6. The method according to claim 1, wherein in the second or later address period in a specific one of the sub-field groups, a voltage for erasing the wall charge is applied again to a cell to which the voltage for erasing the wall charge is applied in an address period before said second or later address period.

7. The method according to claim 6, wherein the specific sub-field group is at least one of the sub-field groups selected in descending order of the weighted luminance.

8. The method according to claim 6, wherein the specific sub-field group is at least one of the sub-field groups selected in descending order of the sum of the weighted luminances of the sub-fields belonging to each of the sub-field groups.

9. The method according to claim 1, wherein in a specific one of the sub-field groups, if all the cells receive a voltage for erasing the wall charge by one or a plurality of erase addressing(s), substantial application of a voltage to the cells is stopped in any sustain period and any address period thereafter.

10. The method according to claim 9, wherein the specific sub-field group is at least one of the sub-field groups selected in descending order of the sum of the weighted luminances of the sub-fields belonging to each of the sub-field groups.

11. The method according to claim 9, wherein the specific group of sub-fields is at least one of the sub-field groups selected in descending order of the number of sub-fields belonging to each of the sub-field groups.

12. The method according to claim 1, wherein, in at least one of the sub-fields selected in ascending order of the weighted luminance, a row scanning cycle for the erase addressing is shorter than the row scanning cycle in other sub-fields.

13. The method according to claim 1, wherein, in at least one of the sub-field groups selected in ascending order of the sum of the weighted luminances of the sub-fields belonging to each of the sub-field groups, a row scanning cycle for the erase addressing is shorter than the row scanning cycle in other sub-field groups.

14. A method for driving an AC-driven PDP having a screen provided with a plurality of pixels arranged in matrix, the pixels having a memory function by use of wall charge, the method comprising the steps of:

dividing a field to be displayed on the screen into a plurality of sub-fields in time sequence, each of the sub-fields being further divided into an address period for selecting a pixel to emit light for display and a display period for sustaining a light-emitting state;

carrying out a charge forming operation for forming wall charge necessary for sustaining the light-emitting state in all the pixels on the entire screen immediately before a set of sequential sub-fields;

carrying out an erase addressing for selectively erasing the wall charge in a pixel which need not emit light, in the address period of a sub-field selected from said set of sequential sub-fields; and controlling the number of sub-fields between the charge forming operation carried out immediately before said set of sequential sub-fields and the erase addressing in the selected sub-field in accordance with luminance of each of the pixels to be displayed.

15. The method according to claim 14, wherein the charge forming operation includes a first step of reversing the polarity of wall charge in an ON-state pixel in which the light-emitting state is sustained in an immediately preceding sustain period and a second step of forming, in an OFF pixel which is a pixel other than the ON-state pixel, wall charge of the same polarity as that in the ON-state pixel.

16. A plasma display device comprising:

a three-electrode surface discharge PDP having a first main electrode and a second main electrode both extending in a direction of a row, an address electrode extending in a direction of a column, and a dielectric layer for covering the first main electrode and the second main electrode against a discharge gas space; and a drive circuit for applying a voltage to the PDP in a sequence to which the method for driving an AC-driven PDP as recited in claim 1 is adapted.

* * * * *